US005992060A

United States Patent [19]

Treu et al.

[11] Patent Number: 5,992,060

[45] Date of Patent: Nov. 30, 1999

[54] METHOD OF AND APPARATUS FOR ANCHOR INSTALLATION

[75] Inventors: Johannes Jacobus Treu, Bellville; Peter George Scott Dove, Magnolia; Gordon R. Wilde, Houston, all of Tex.

[73] Assignee: Aker Marine, Inc., Houston, Tex.

[21] Appl. No.: 08/971,518

[22] Filed: Nov. 17, 1997

[51] Int. Cl.[6] ..... E02D 7/00

[52] U.S. Cl. ..... 37/345; 405/224; 114/296

[58] Field of Search ..... 37/323, 325, 345; 114/296, 295, 264, 265, 230.13; 405/224, 195.1, 226, 204

[56] References Cited

U.S. PATENT DOCUMENTS

| | | | |
|---|---|---|---|
| 3,295,489 | 1/1967 | Bossa | 114/230 |
| 3,411,473 | 11/1968 | Mott et al. | 114/296 |
| 3,431,879 | 3/1969 | Westling | 405/224 X |
| 3,540,396 | 11/1970 | Horton | 114/230 |
| 3,602,174 | 8/1971 | Gorman | 114/230 |
| 3,703,151 | 11/1972 | Clement | 114/230 |
| 3,965,687 | 6/1976 | Shaw | 37/323 X |
| 4,024,718 | 5/1977 | Roche et al. | 405/190 |
| 4,086,866 | 5/1978 | Nixon | 114/295 |
| 4,164,195 | 8/1979 | Frigeni | 114/322 |
| 4,222,591 | 9/1980 | Haley | 285/920 X |
| 4,257,721 | 3/1981 | Haynes | 405/227 |
| 4,318,641 | 3/1982 | Hogervorst | 405/224 |
| 4,347,012 | 8/1982 | Glidden | 403/2 |
| 4,432,671 | 2/1984 | Westra et al. | 405/226 |
| 4,439,068 | 3/1984 | Poklandnik | 166/338 X |
| 4,575,282 | 3/1986 | Pardue, Sr. et al. | 405/224 |
| 4,601,608 | 7/1986 | Ahlstone | 285/920 X |
| 4,635,728 | 1/1987 | Harrington | 166/341 |
| 4,721,415 | 1/1988 | Shatto | 405/224.1 |
| 4,733,993 | 3/1988 | Andreasson | 405/224 |
| 4,807,373 | 2/1989 | Sloan et al. | 37/323 X |
| 4,830,541 | 5/1989 | Shatto | 405/226 |
| 4,854,058 | 8/1989 | Sloan et al. | 37/323 X |
| 4,940,362 | 7/1990 | Paulshus et al. | 405/224 |
| 5,041,038 | 8/1991 | Poldervaart et al. | 440/5 |
| 5,159,891 | 11/1992 | Lohr et al. | 114/230 |
| 5,480,521 | 1/1996 | Snyder, Jr. et al. | 166/338 X |
| 5,704,307 | 1/1998 | Treu et al. | 114/230 |

FOREIGN PATENT DOCUMENTS

| | | | |
|---|---|---|---|
| 610714 | 5/1978 | U.S.S.R. | 114/296 |
| 797955 | 1/1981 | U.S.S.R. | 114/296 |

OTHER PUBLICATIONS

Telefax memo from Aker Omega Marine, Inc. to Shell Offshore, Inc. dated May 7, 1991.

Telefax memo from Aker Omega Marine, Inc. to Shell Offshore, Inc. dated Jun. 17, 1991.

Brochure entitled "Hicap® Suction Embedded Anchors". Author: UMOE Anchor Contracting Publication date: Unknown.

*Primary Examiner*—Robert E Pezzuto
*Attorney, Agent, or Firm*—Gardere & Wynne, L.L.P.

[57] ABSTRACT

In a method of and apparatus for anchor installation, a plate anchor is mounted at the bottom of a suction follower comprising a hollow cylinder having an open lower insertion end and a closable upper suspension end. The suction follower and the anchor secured thereto are engaged with the sea floor, whereupon water is pumped out of the suction follower causing the suction follower and the anchor to penetrate into the sea floor to a predetermined depth. The anchor is then disengaged from the suction follower, whereupon water is pumped into the suction follower to disengage the suction follower from the sea floor for recovery to the surface, leaving the anchor embedded in the sea floor.

28 Claims, 14 Drawing Sheets

METHOD OF AND APPARATUS FOR ANCHOR INSTALLATION

TECHNICAL FIELD

This invention relates generally to methods of and apparatus for effecting anchor installation and recovery, and more particularly to the installation of plate anchors in deep water.

BACKGROUND AND SUMMARY OF THE INVENTION

As is well known, exploration for and recovery of oil and gas has long since extended into offshore venues. Early offshore drilling operations were concentrated in relatively shallow waters. However, the number of shallow water drilling sites is finite, while the world's appetite for oil and gas is seemingly unlimited. It has therefore become necessary to conduct offshore drilling operations in waters as deep as 10,000 feet or more.

Offshore drilling operations are frequently conducted from floating platforms known as mobile offshore drilling units (MODUs) with following production operations being conducted using floating production systems. While the mooring in shallow water is relatively straightforward, the successful mooring of MODUs, floating production systems, etc., in deeper water can be problematic.

The traditional method of mooring MODUs, for example, in deeper water involves the use of drag embedment anchors and mooring lines which are stored on the MODU, and which are deployed from the MODU using anchor handling vessels. Some of the latest generation MODUs can carry adequate lengths of wire and chain on board, and are equipped with combination wire/chain mooring winches to moor at maximum depths of 5,000 feet of water. Large anchor handling vessels are capable of deploying and recovering such mooring legs and anchors. In even deeper water, however, the amount of wire and chain that would have to be carried on the MODU becomes too large, and even large anchor handling vessels would have difficulty deploying and recovering such mooring systems in the traditional manner.

Older generation MODUs typically cannot carry enough mooring line to moor in water deeper than about 2,000 to 3,000 feet. This water depth limit can be extended by inserting sections of wire in each mooring leg, or by pre-installing mooring legs prior to arrival of the MODU at location. Both types of extended water depth mooring legs (insert or preset) typically use modern high holding power drag embedment anchors. Large anchor handling vessels are used to install the wire inserts during mooring leg deployment or to pre-install the preset mooring legs.

One drawback to deep water moorings using drag embedment anchors is that such anchors typically cannot handle uplift (vertical load), which requires both that the mooring leg is very long, and that the anchor is set very far from the MODU. In water depths over 6,000 feet the horizontal distance to the anchors can become a problem, since it could be as large as 12,000 feet or 2 nautical miles, and each mooring leg could be as long as 15,000 feet or 2.5 nautical miles. This requires an anchor spread diameter of about 4 nautical miles.

If an anchor system can be used which can handle substantial uplift or vertical load, the anchor radius and mooring line length can be reduced significantly. Driven anchor piles are capable of handling uplift, but cannot be installed in water deeper than about 5,000 feet, nor are they recoverable. For these reasons, driven anchor piles have never been used for deep water moorings.

Mooring systems employing anchors other than conventional drag embedment anchors and driven piles have been proposed heretofore. For example, two types of drag embedded vertically loaded anchors are commercially available. The installation of these drag embedded vertically loaded anchors in deep water requires the connection of a very long length of chain and/or wire between the anchor and the installing vessel in order that a substantially horizontally directed embedment force can be applied to the anchor. Due to its extreme length, the mass of the installing chain and/or wire exceeds that of the anchor by a considerable extent, which causes the anchor to respond to whatever forces may be imposed by the chain and/or wire, including in particular twisting forces. The end result is that it is very difficult to assure the proper orientation, location, and depth of installation of drag embedded vertically loaded anchors installed in deep water.

The foregoing difficulties in installing drag embedded vertically loaded anchors have resulted in renewed interest in the use of suction anchors for deep water installations. U.S. Pat. No. 4,318,641, granted to Hogervorst on Mar. 8, 1992, discloses mooring systems employing suction embedment anchors, which are capable of taking significant uplift or vertical load. One difficulty involved in the use of suction anchors comprises the high cost thereof, which can be $200,000 or more. Another difficulty involves the large size and weight of suction anchors which results in transportation and deployment problems. Therefore, a need exists for an improved method of and apparatus for installing anchors in deep water.

The present invention comprises a method of and apparatus for installing anchors which overcomes the foregoing and other problems long since associated with the prior art. In accordance with the broader aspects of the invention, a plate anchor is temporarily connected to the lower insertion end of a suction follower. A mooring line is connected to the plate anchor and is temporarily connected to the suction follower. The suction follower having the plate anchor secured thereto is lowered from an installation vessel until it engages and partially penetrates the ocean floor under its own weight.

Thereafter, a remotely operated vehicle having a pump mounted thereon is engaged with the suction follower and is utilized to pump water out of the interior of the suction follower. This results in further penetration of the suction follower and the plate anchor secured thereto until the desired depth is reached. The plate anchor and the mooring line are then disengaged from the suction follower, whereupon the operation of the pump on the remotely operated vehicle is reversed. As water is pumped into the suction follower it is forced upwardly out of the ocean floor and is recovered to the installation vehicle. The plate anchor remains embedded in the ocean floor for use in mooring operations, and when a load is applied will orient itself into the correct attitude. The plate anchor may be recovered later if desired.

BRIEF DESCRIPTION OF THE DRAWINGS

A more complete understanding of the present invention may be had by reference to the following Detailed Description when taken in connection with the accompanying Drawings wherein.

DETAILED DESCRIPTION

Figure 1:
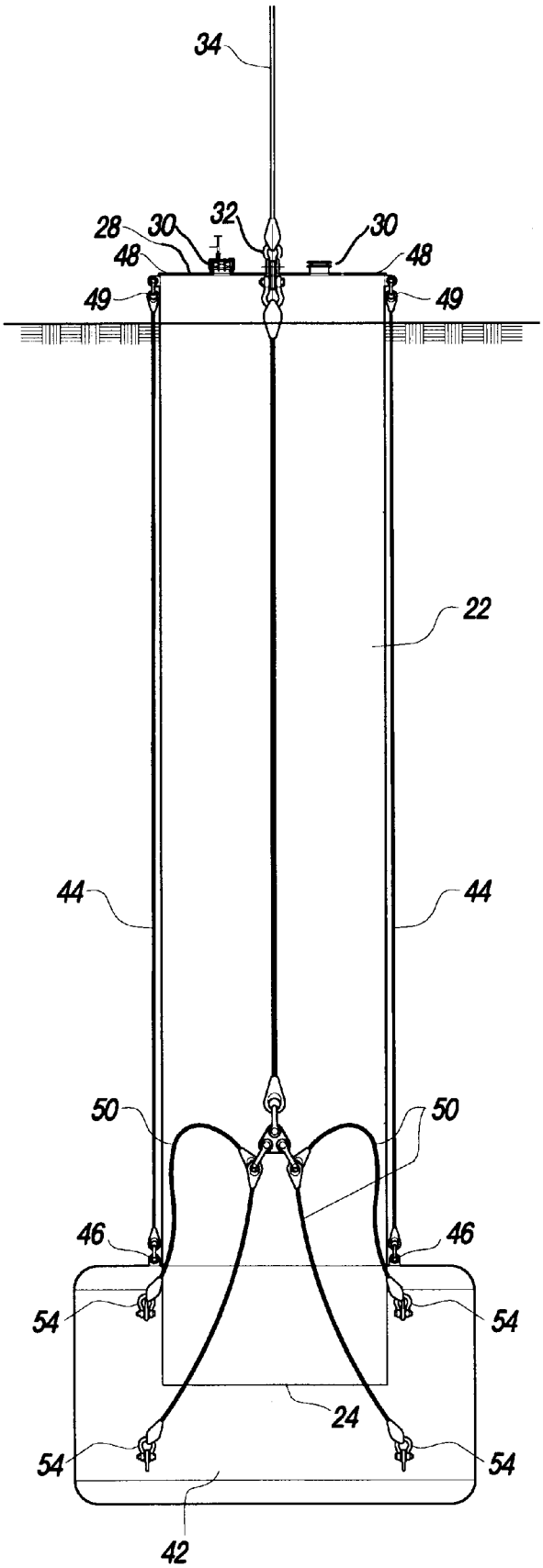
FIG. 1 is a front view illustrating a first embodiment of the invention.

Referring now to the Drawings, and particularly to FIG. 1 thereof, there is shown an anchor installation system 20 comprising a method of and apparatus for anchor installation incorporating a first embodiment of the invention. The anchor installation system 20 includes a suction follower 22. The suction follower 22 comprises a hollow right circular cylinder formed from steel and having a diameter of about 14 feet and a length of about 70 feet. Other cross-sectional configurations and/or other dimensions may be used in the fabrication of the suction follower 22 depending upon the requirements of particular applications of the invention.

Figure 2:
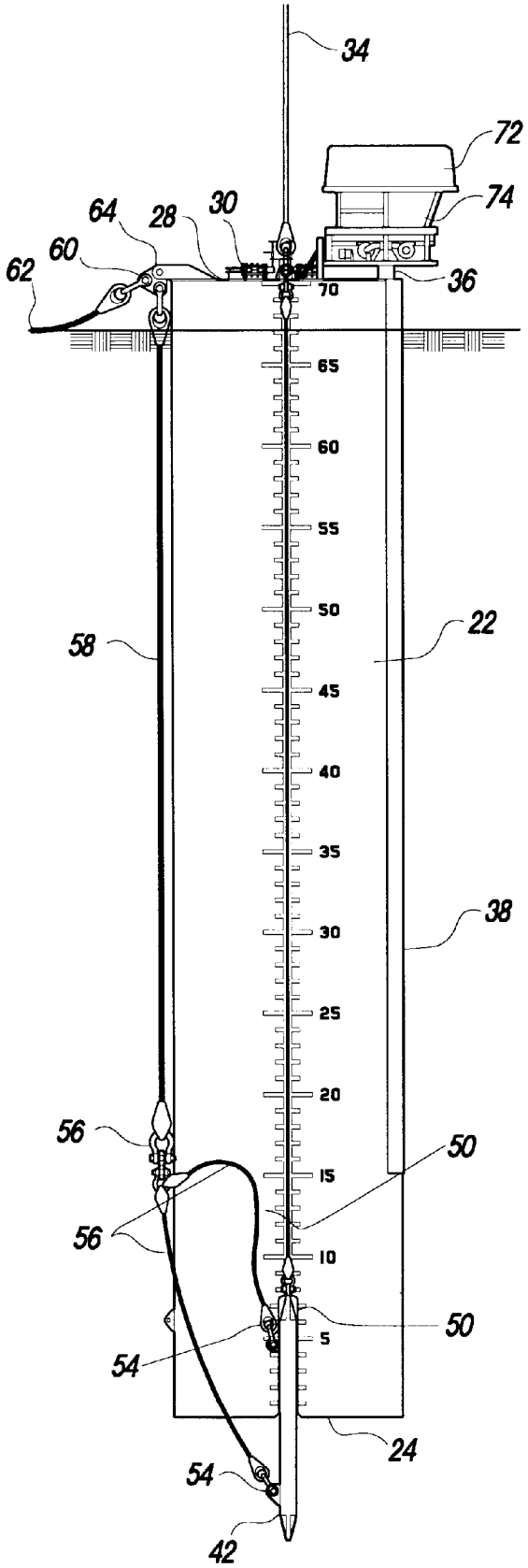
FIG. 2 is a side view further illustrating the embodiment of the invention shown in FIG. 1.

The suction follower 22 has a lower insertion end 24 which is open and an upper suspension end 26 which is closed by a top plate 28. The top plate 28 is provided with flow-through ports 30 and a pad eye 32 which secures the suction follower 22 to a lowering/recovery wire 34. As is best shown in FIG. 2, the top plate 28 is further provided with a suction port 36. A pair of longitudinally disposed launching skids 38 extend along one side of the suction follower 22. The launching skids 38 function to prevent the suction follower from rolling on the deck of an installation vessel.

The suction follower 22 is similar in construction and function to the suction anchor disclosed and claimed in U.S. patent application Ser. No. 08/948227 filed Oct. 9, 1997, and assigned to the assignee hereof, the disclosure of which is incorporated by reference herein as if fully set forth herein. The difference between the two is that the suction anchor of the prior application is installed in the sea floor and thereafter serves an anchoring function, whereas the suction follower of the present invention comprises an anchor installation device but does not itself function as an anchor.

The suction follower 22 has a slot 40 formed in the lower insertion end 24 thereof. The slot 40 is generally rectangular in shape, is disposed on the axis of the suction follower 22, and extends longitudinally inwardly from the lower end 24. Slots having other shapes and other locations relative to the suction follower 22 may be used in the practice of the invention depending upon the requirements of particular applications thereof.

A plate anchor 42 is received in the slot 40. The plate anchor 42 is preferably formed from steel and may be either solid or hollow in construction. The plate anchor 42 illustrated in FIGS. 1 and 2 is rectangular in shape; however, it will be understood that plate anchors having other shapes may be utilized in the practice of the invention, if desired.

Referring particularly to FIG. 1, the plate anchor 42 is retained in the slot 40 during installation by a pair of retainer wires 44 extending along opposite sides of the suction follower 22. The lower ends of the retainer wires 44 are secured to pad eyes 46 mounted on the plate anchor 42. The upper ends of the retainer wires 44 are secured to brackets 48 mounted on the suction follower 22 at the upper end thereof. The retainer wires 44 are releaseably secured to the brackets 48 by means of releaseable pins 49.

An anchor bridle assembly 50 includes a plurality of bridle wires 52 each secured to a pad eye 54 mounted on the plate anchor 42. Each of the wires 52 extends from its respective pad eye 54 to a connection plate 56 which connects the bridle assembly to an anchor forerunner wire 58. Referring to FIG. 2, the anchor forerunner wire 58 extends from the plate 56 to a triplate 60 which secures the anchor forerunner wire 58 to a mooring line 62. During installation of the plate anchor 42, the triplate 60 is secured to a bracket 64 mounted on the top plate 28 of the suction follower 22 by a releaseable pin 66.

In the operation of the anchor installation system 20, the plate anchor 42 is initially secured in the slot 40 of the suction follower 22 by means of the retainer wires 44 each of which is connected to its respective bracket 48 by means of a releaseable pin 49. The suction follower/plate anchor assembly is transported to the installation site on an installation vessel. During transportation the suction follower 22 is prevented from rolling on the deck of the installation vessel by means of the launching skids 38 which are engaged with the deck of the vessel.

At the installation site the suction follower/plate anchor assembly is lowered downwardly from the vessel until it is positioned directly above the sea floor 70. A remotely operated vehicle 72 is then utilized to assure that the plate anchor 42 is properly oriented. Thrusters on the remotely operated vehicle 72 may be utilized to reposition the suction follower/plate anchor assembly if necessary. The remotely operated vehicle 72 may comprise a Raycal Sea Lion MkII heavy work class remotely operated vehicle having 100 horsepower; however, any of the various commercially available remotely operated vehicles having 75 horsepower or more can be used in the practice of the invention.

After the proper orientation of the plate anchor has been assured, the suction follower/plate anchor assembly is lowered into engagement with the sea floor 70 and penetrates the sea floor 70 under its own weight. At this point the remotely operated vehicle 72 is again utilized to assure that the axis of the suction follower 22 is vertically oriented. The suction follower 22 may be provided with a bulls-eye level mounted on the top plate 28 thereof for observation by the remotely operated vehicle 72 to assure proper vertical alignment of the suction follower 22.

After the proper orientation of the plate anchor 42 and the proper vertical alignment of the suction follower 22 have been assured utilizing the remotely operated vehicle 72, the remotely operated vehicle 72 is utilized to close the flow-through ports 30. Thereafter, a pumpskid 74 mounted on the remotely operated vehicle 72 is clamped into engagement with the suction port 36 of the suction follower 22. The pumpskid 74 is preferably of the type disclosed and claimed in co-pending application Ser. No. 08/959,931, filed Oct. 29, 1997, [attorney docket no. 901033-14] and assigned to the assignee of the present application, the disclosure of which is incorporated herein by reference as if fully set forth herein.

The pumpskid 74 includes a pump which functions responsive to power supplied by the remotely operated vehicle 72 to pump water out of the interior of the suction follower 22. This results in a differential pressure between the interior and the exterior of the suction follower 22, whereby the suction follower 22 and the plate anchor 42 are forced into the sea floor 70. The pumping of water out of the interior of the suction follower 22 and the resulting penetration of the suction follower 22 and the plate anchor 42 into the sea floor 70 continues until the desired depth of penetration is achieved. A typical maximum penetration depth is indicated in FIGS. 1 and 2.

After the desired penetration depth has been achieved, the remotely operated vehicle 72 is utilized to disengage the releaseable pins 49, thereby disengaging each retainer wire 44 from its respective pad eye 48. Likewise, the remotely operated vehicle 72 is utilized to disengage the releaseable pin 66, thereby disengaging the triplate 60 from the bracket 64. Thereupon the remotely operated vehicle 72 and the pumpskid 74 are returned to the position indicated in FIG. 2, and the pumpskid 74 is once again clamped into engagement with the suction port 36 of the suction follower 22.

At this point the pump of the pumpskid 74 is utilized to pump water into the suction follower 22. This causes a pressure differential between the interior of the suction follower 22 and the exterior thereof which causes the suction follower 22 to move upwardly and out of engagement with the sea floor 70. Disengagement of the suction follower 22 from the sea floor 70 is aided by an upwardly directed force applied to the suction follower 22 from the installation vessel through the lowering/recovery wire 34. It will also be understood that since the releaseable pins 49 and 66 have been disengaged, upward movement of the suction follower 22 does not result in upward movement of the plate anchor 42. Rather, the plate anchor 42 remains in place at its maximum penetration depth while the suction follower 22 is removed from the sea floor 70 and returned to the surface utilizing the lowering/connection wire 34.

It will be understood that by means of suitable connections, the remotely operated vehicle can be used to disengage the pins 49 and 66 without disconnecting from the suction port.

Figure 3:
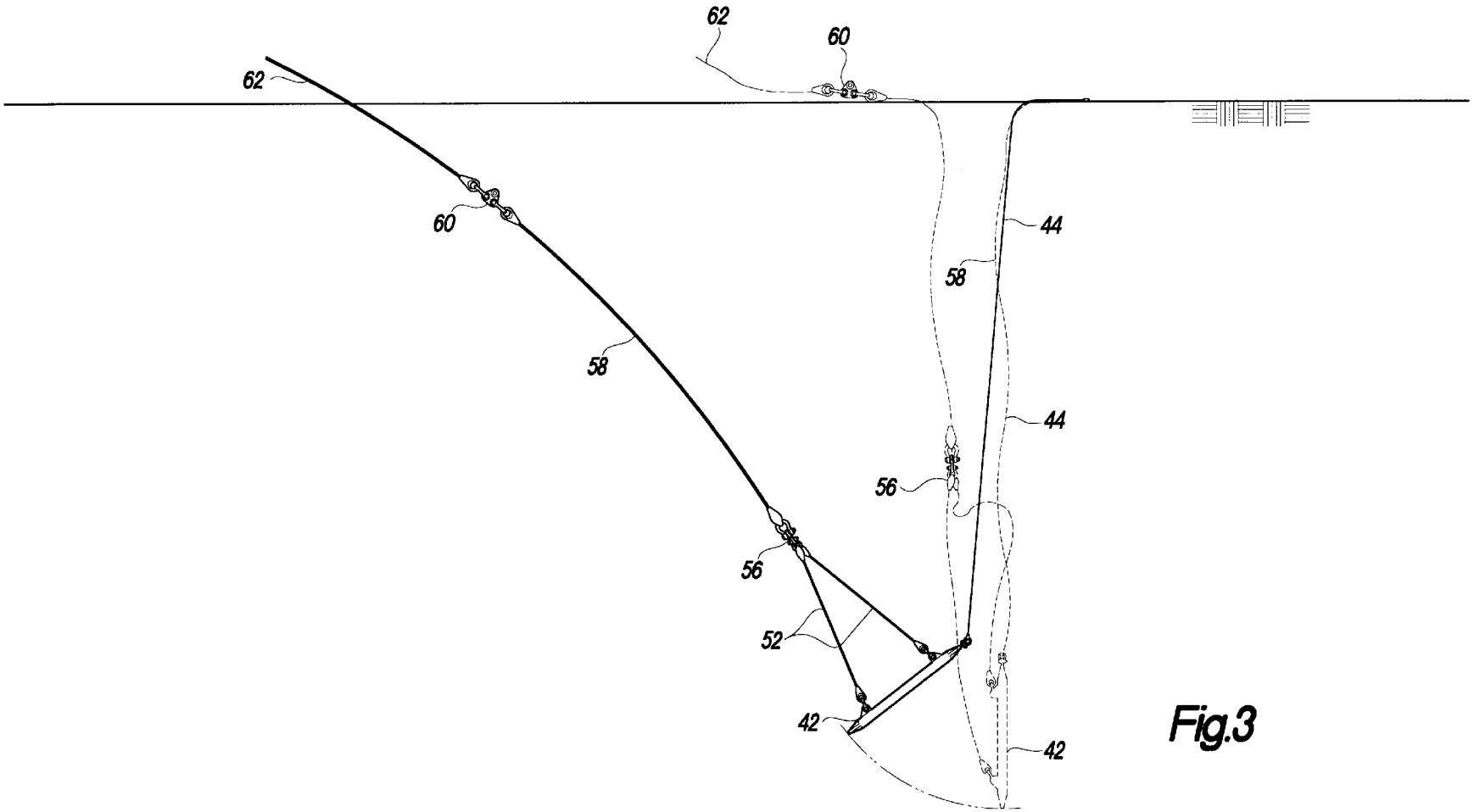
FIG. 3 is an illustration of a plate anchor installed in accordance with the first embodiment of the invention.

Referring to FIG. 3, the positioning of the plate anchor 42 following removal of the suction follower 22 is indicated in dashed lines. Thereafter, an object to be moored utilizing the plate anchor 42, for example, a MODU, is secured to the mooring line 62, it being understood that pre-connection of the device to be moored to the plate anchor is also possible. A mooring force is then applied to the plate anchor 42 through the mooring line 62 and the anchor forerunner wire 58, causing the plate anchor 42 to move into the orientation show in full lines of FIG. 3. However, since the plate anchor 42 has been inserted into the sea floor 70 to a depth of approximately 70 feet, the plate anchor 42 does not disengage from the sea floor, but rather provides a very dependable anchoring resistance to any movement of the device secured thereto through the mooring line 62.

Figure 4:
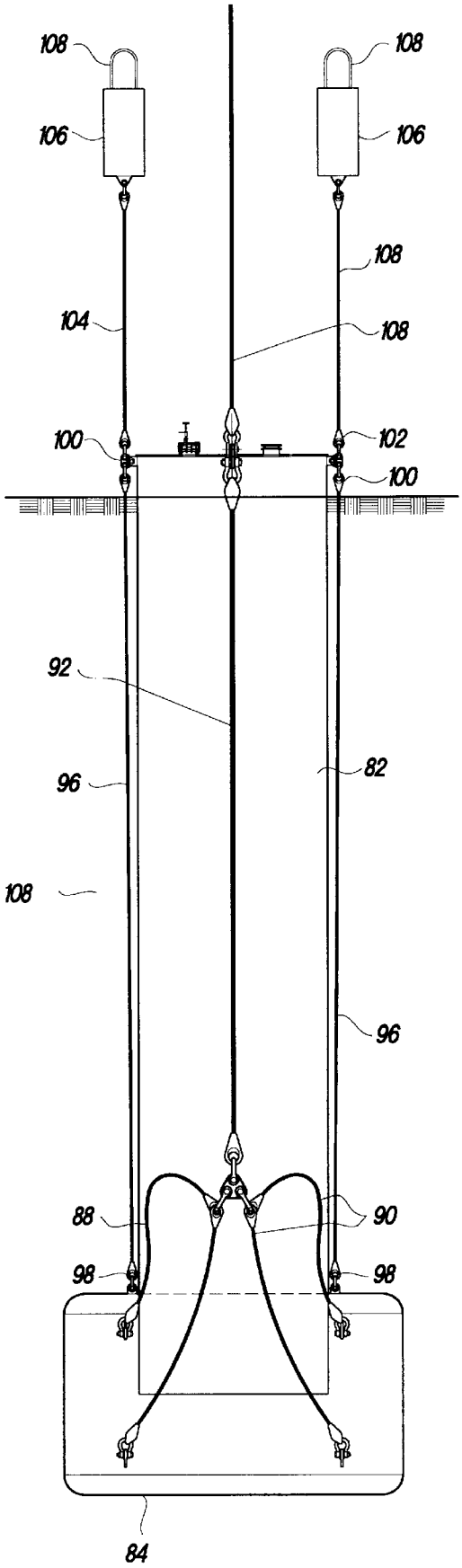
FIG. 4 is a front view illustrating a second embodiment of the invention.
Figure 5:
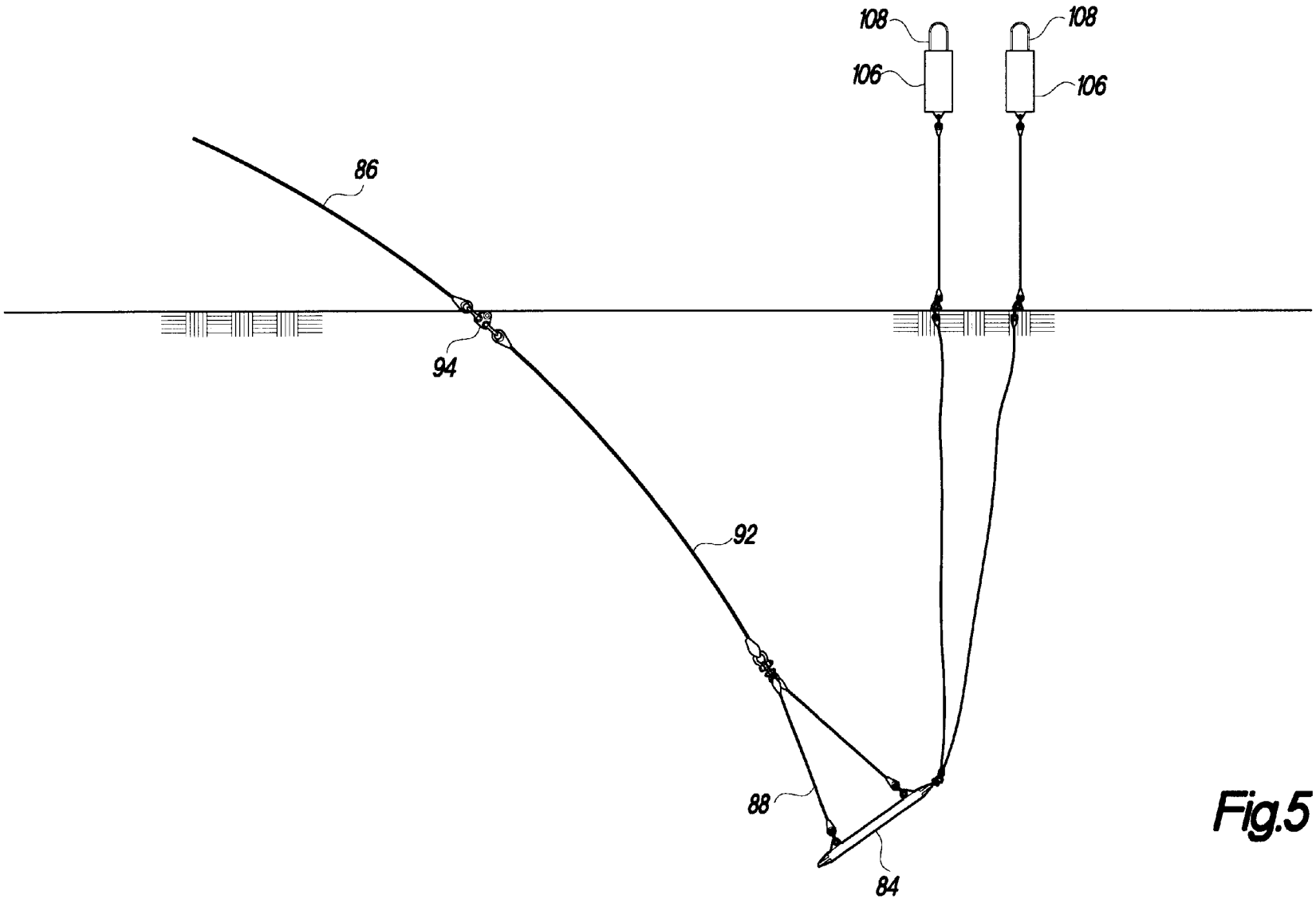
FIG. 5 is an illustration of a plate anchor installed in accordance with the second embodiment of the invention.

Referring now to FIGS. 4 and 5, there is shown an anchor installation system 80 comprising a method of and apparatus for anchor installation incorporating a second embodiment of the invention. The anchor installation system 80 utilizes a suction follower 82 which is identical in construction and function to the suction follower 22 illustrated in FIGS. 1 and 2 and described hereinabove in conjunction therewith. The anchor installation system 80 is utilized to install a plate anchor 84 which is identical in construction and function to the plate anchor 42 illustrated in FIGS. 1, 2, and 3 and described hereinabove in conjunction therewith. The plate anchor 84 is connected to a mooring line 86 by means of a bridle assembly 88 including bridle wires 90. The bridle assembly 88 connects the plate anchor 84 to the mooring line 86 through an anchor forerunner wire 92 and a triplate 94 which is detachably connected to the suction follower 82 during installation of the plate anchor 84.

During installation, the plate anchor 94 is connected to the suction follower 82 by means of retrieval/retainer wires 96. Each retrieval/retainer wire 96 extends from a pad eye 98 secured to the plate anchor 84 and is connected to a triplate 100. Each triplate 100 is connected to the suction follower 82 by means of a releaseable pin 102 which is disengageable following installation utilizing the remotely operated vehicle 72 illustrated in FIGS. 1 and 2 and described hereinabove in conjunction therewith.

A retrieval pendant 104 extends from each triplate 100. A small buoy 106 formed from syntactic foam is secured to the distal end of each recovery pendant 104. Each buoy 106 is provided with an eye 108 adapted for engagement by a hook secured to a recovery line extending from an installation vessel by means of the remotely operated vehicle 72.

Referring particularly to FIG. 5, following installation and after the application of a mooring force thereto, the plate anchor 84 is oriented similarly to the orientation of the plate anchor 42 as shown in FIG. 3 and described hereinabove in conjunction therewith. The buoys 106 are positioned above the sea floor and locate the eyes 108 for engagement by hooks extending from recovery lines. The recovery lines are adapted to apply a retrieval force to the plate anchor 84 through the retrieval pendants 104 and the retrieval/retainer wires 96, thereby disengaging the plate anchor 84 from the sea floor for recovery and reuse.

In certain instances it may be preferable to use a single retrieval pendant 104, buoy 106, and eye 108 to prevent tangling. Any desired number of such components can be used depending upon the requirements of specific applications of the invention.

Figure 6:
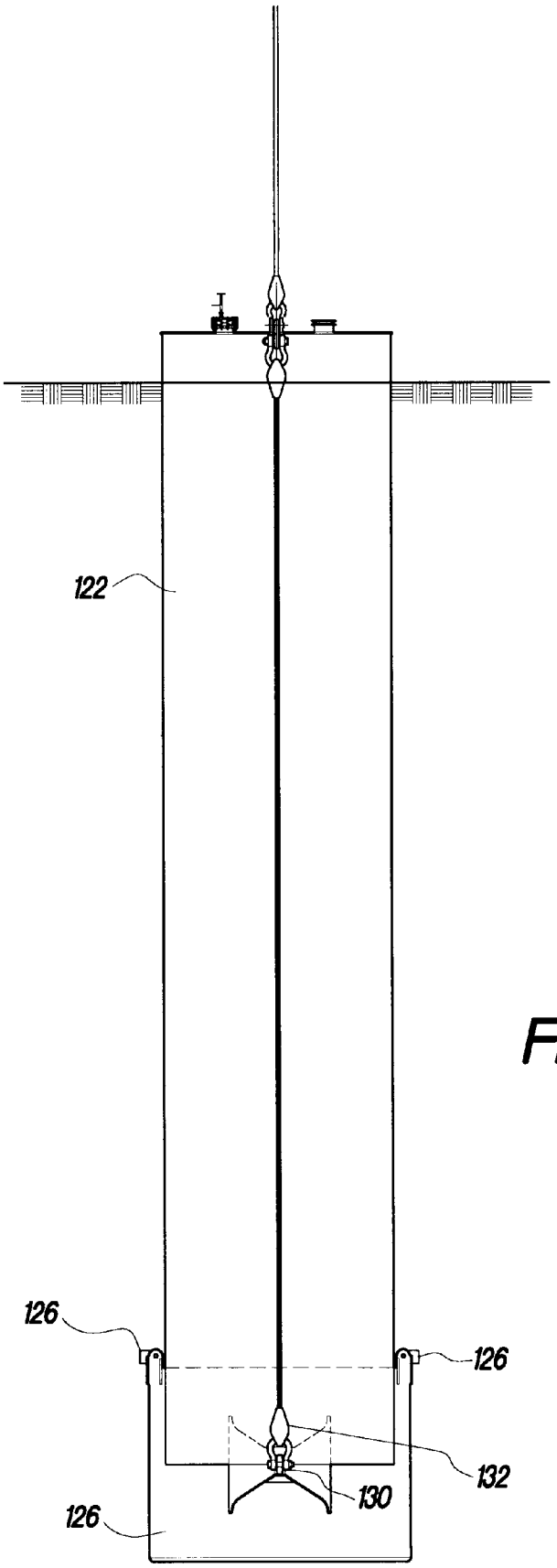
FIG. 6 is a front view illustrating a third embodiment of the invention.
Figure 7:
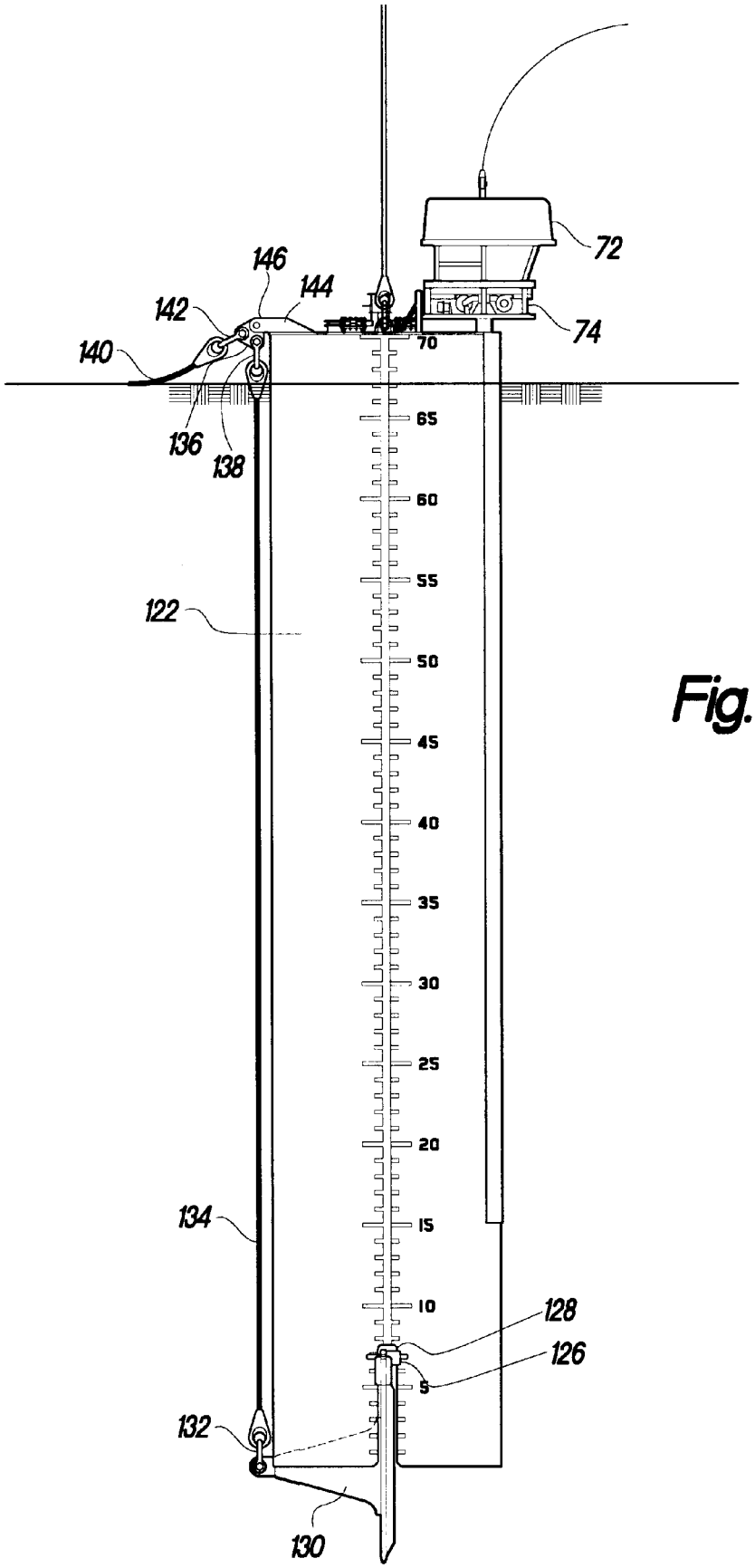
FIG. 7 is a side view further illustrating the embodiment of the invention shown in FIG. 6.
Figure 8:
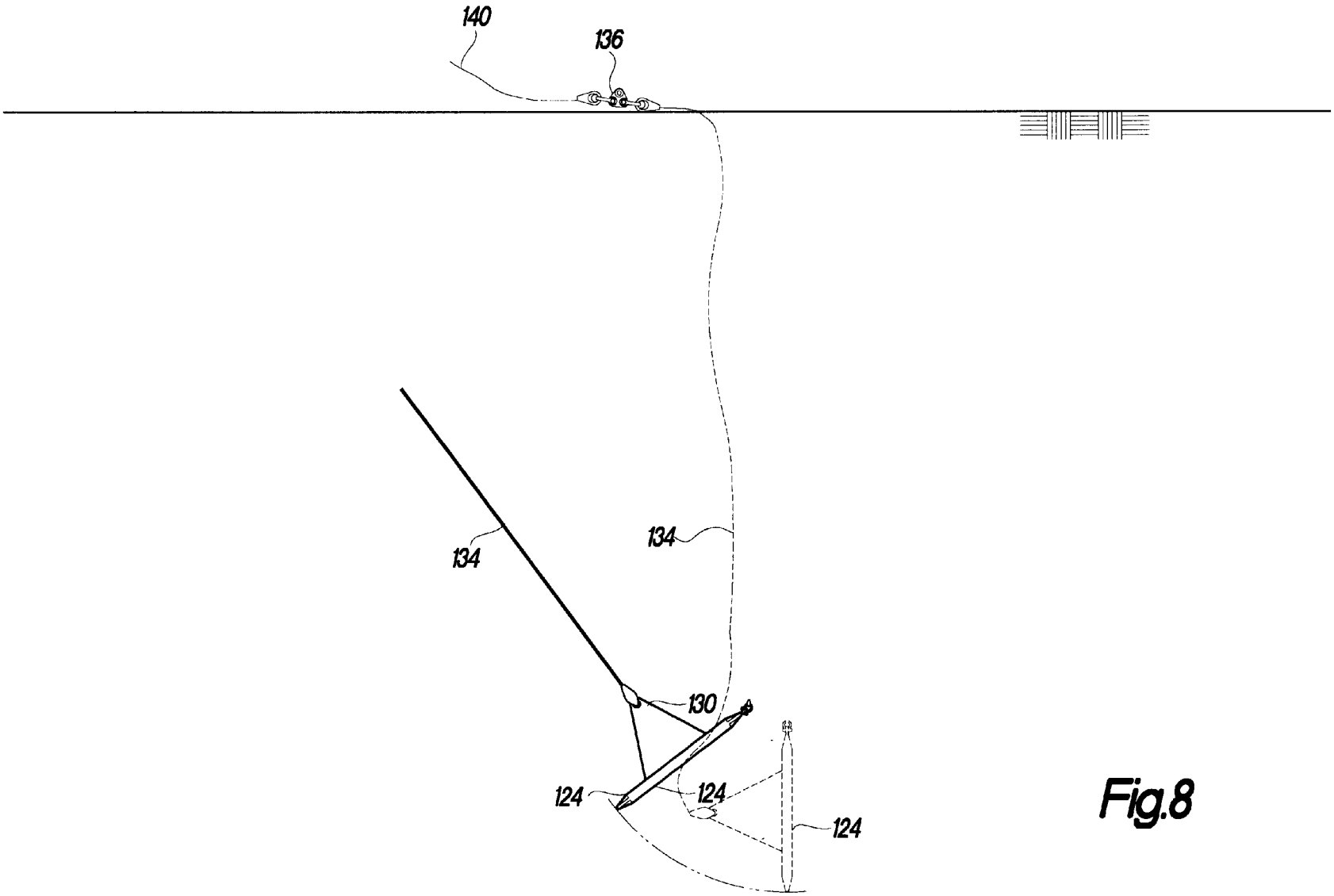
FIG. 8 is an illustration of a plate anchor installed in accordance with the third embodiment of the invention.

Referring now to FIGS. 6, 7, and 8, there is shown an anchor installation system 120 comprising a method of and apparatus for anchor installation incorporating a third embodiment of the invention. The anchor installation system 120 utilizes a suction follower 122 which is identical in construction and function to the suction follower 22 illustrated in FIGS. 1 and 2 and described hereinabove in conjunction therewith.

The suction follower 122 is utilized to effect installation of a plate anchor 124. One difference between the anchor installation system 20 in FIGS. 1, 2, and 3, and the anchor installation system 120 of FIGS. 6, 7, and 8 is that the plate anchor 124 is connected to the suction follower 122 by means of pins 126 which are selectively withdrawn to disengage the plate anchor 124 from the suction follower 122 utilizing hydraulic actuators 128 which are operated by the remotely operated vehicle 72 illustrated in FIGS. 1 and 2 and described hereinabove in conjunction therewith.

The plate anchor 124 is provided with an anchor shank 130. A shackle 132 secures the shank 130 to an anchor forerunner line 134. The anchor forerunner line 134 is in turn connected to a triplate 136 by means of a shackle 138. A mooring line 140 is also connected to the triplate 136 by means of a shackle 142.

During installation of the plate anchor 124, the triplate 136 is connected to a bracket 144 mounted on the suction follower 122 by means of a pin 146 extending therethrough. The pin 146 is adapted for disengagement from the triplate 136 and the bracket 144 under the action of a hydraulic actuator identical in construction and function to the hydraulic actuator 128. The hydraulic actuator for the pin 146 is actuated by the remotely operated vehicle 72.

Referring particularly to FIG. 8, the positioning of the plate anchor 124 following installation is indicated in dashed lines. Upon the application of an anchoring force to the plate anchor 124 through the mooring line 140, the triplate 136, and the anchor forerunner wire 134, the plate anchor 124 assumes the positioning indicated in FIG. 8 in full lines. At this point the plate anchor 124 is securely embedded in the sea floor and is fully capable of resisting anchoring forces applied thereto from a device secured to the opposite end of the mooring line 140.

Figure 9:
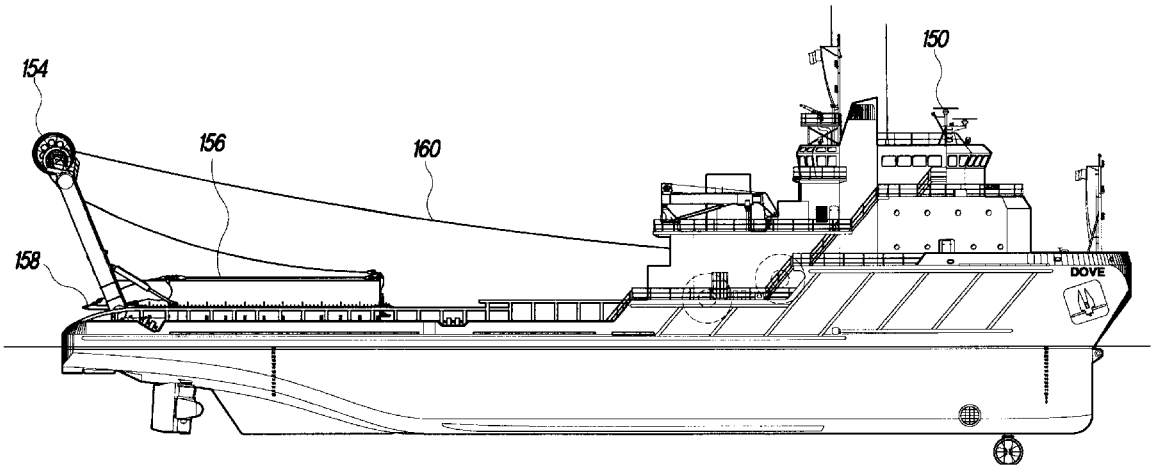
FIG. 9 is an illustration of a first step in the practice of the method of the invention.

Referring to FIGS. 9 through 14, inclusive, the method of anchor installation comprising the present invention is further illustrated. Referring particularly to FIG. 9, an installation vessel 150 is provided with an A-frame gantry shown in positions 152 and 154. A suction follower 156, which is identical in construction and function to the suction followers 22, 82, and 122 illustrated in FIGS. 1, 2, 4, 6, and 7 hereof and described hereinabove in conjunction therewith is mounted on the deck of the vessel 150. A plate anchor 158 is installed on the suction follower 156 either prior to or after the positioning of the suction follower 156 on the deck of the vessel 150. The plate anchor 158 may be identical in construction and function to any of the plate anchors 42, 84, and 124 illustrated in FIGS. 1 through 8, inclusive, hereof and described hereinabove in conjunction therewith.

Figure 10:
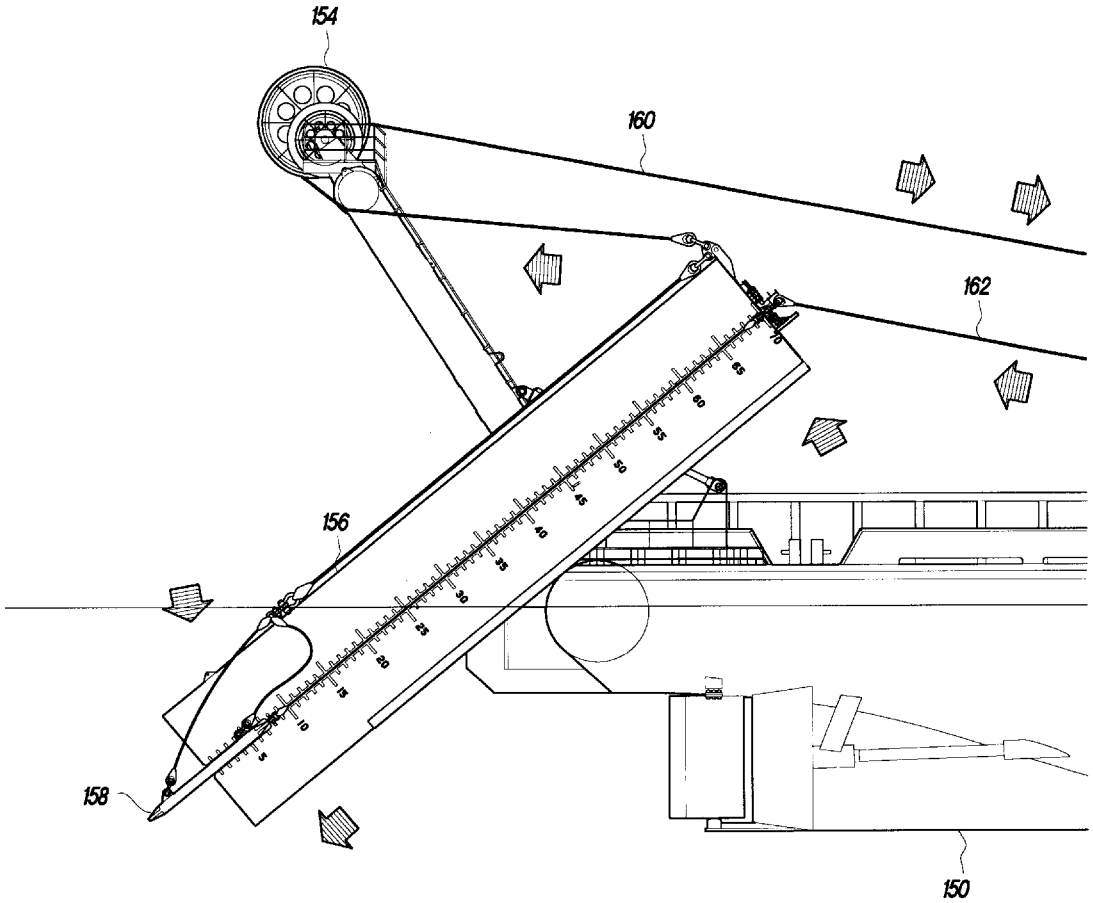
FIG. 10 is an illustration of a subsequent step in the practice of the method of the invention.
Figure 11:
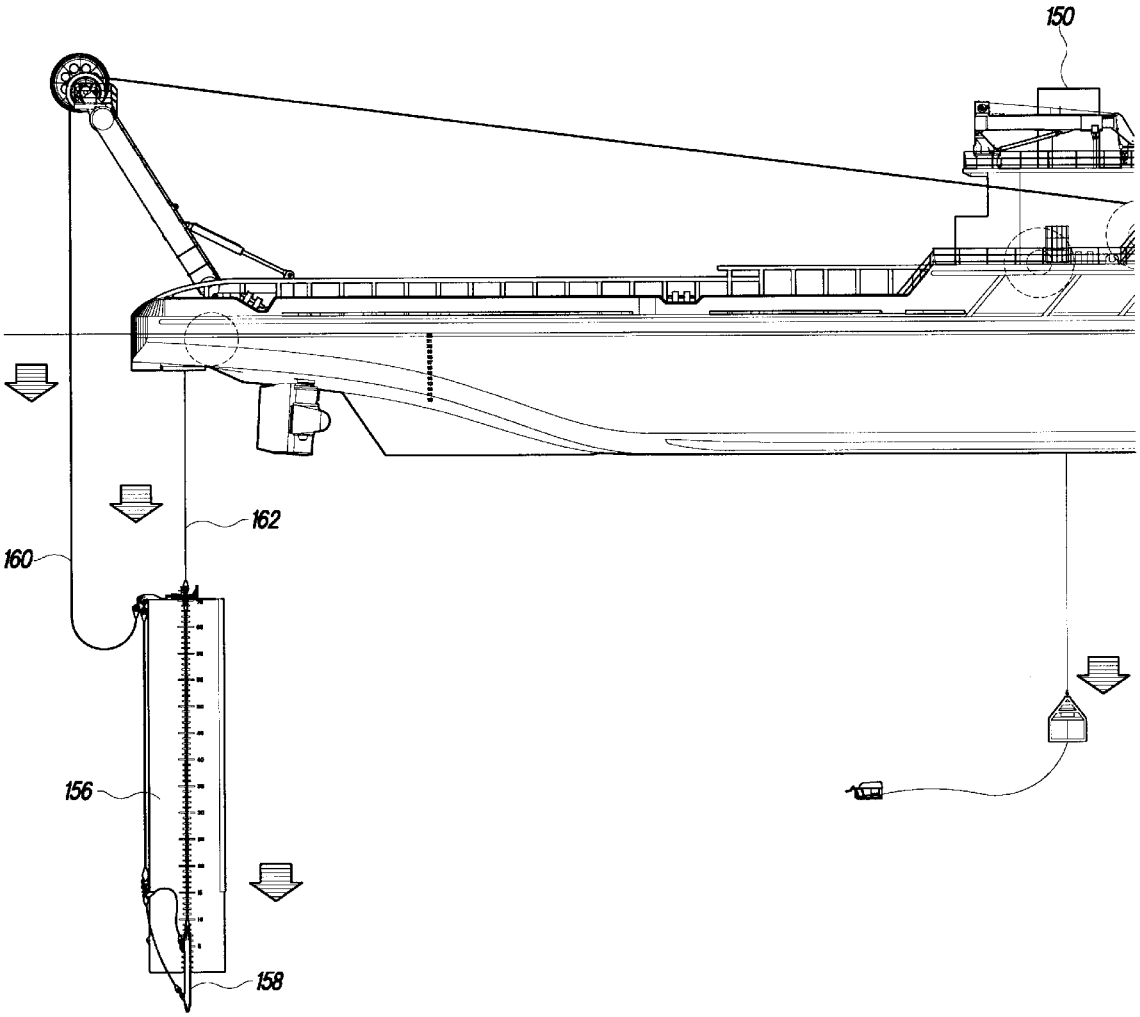
FIG. 11 is an illustration of a later step in the practice of the method of the invention.

The vessel 150 is utilized to transport the suction follower/plate anchor assembly to the point of installation. A mooring line 160 is deployed from a suitable winch over the gantry and is engaged with the plate anchor 158 and initially with the suction follower 156. A lowering/recovery wire 162 is deployed from a suitable winch and is secured to the suction follower 156. Referring to FIG. 10, the gantry is utilized to lift the suction follower/plate anchor assembly and to move it rearwardly, whereupon the suction follower/plate anchor assembly passes over a stern roller of the vessel 150 and enters the ocean. As is illustrated in FIG. 11, the suction follower/plate anchor assembly is lowered downwardly utilizing the lowering/recovery line 162 with the mooring line 160 following.

Figure 12:
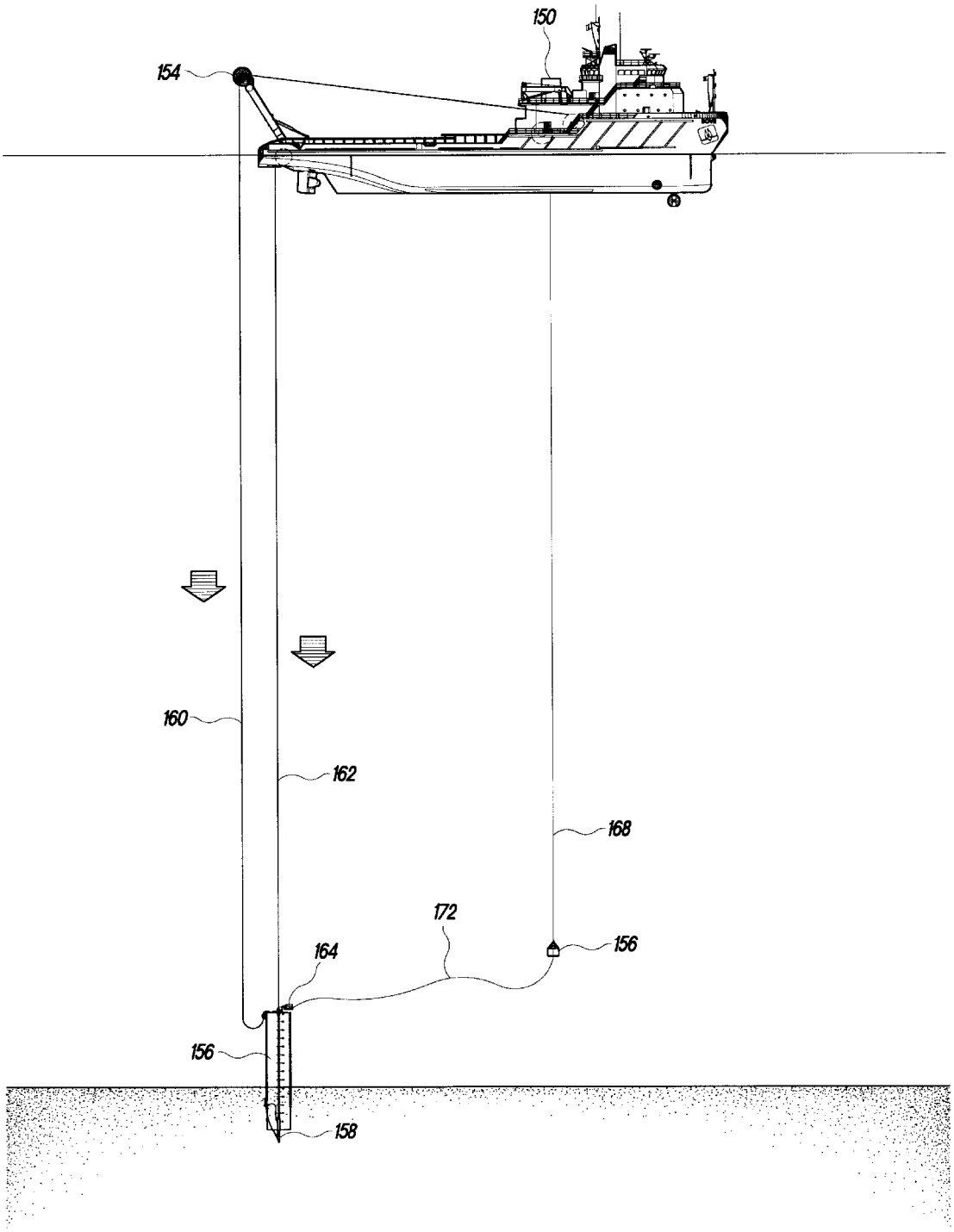
FIG. 12 is an illustration of a still later step in the practice of the method of the invention.

Referring to FIG. 12, a remotely operated vehicle 164 having a pumpskid 166 secured thereto is also deployed from the vessel 150. The remotely operated vehicle 164 and the pumpskid 166 are preferably identical in construction and function to the remotely operated vehicle 72 and the pumpskid 74 illustrated in FIGS. 1 and 2 and described hereinabove in conjunction therewith. The remotely operated vehicle 164 is connected to the vessel 150 by a line 168 which supplies operating power and control functions for the remotely operated vehicle 164 and the pumpskid 166. A remotely operated vehicle/pumpskid housing 170 is secured to the lower end of the line 168. An umbilical cord 172 secures the remotely operated vehicle 164 to the housing 170.

When the suction follower/plate anchor assembly is positioned just above the surface of the sea floor 174, the remotely operated vehicle 164 is utilized to assure the proper orientation of the plate anchor 158. Thrusters on the remotely operated vehicle re-orient the suction follower/plate anchor if necessary. Thereafter, the suction follower/plate anchor assembly is lowered further and penetrates the sea floor 174 under its own weight. At this point the remotely operated vehicle 164 is utilized to assure that the axis of the suction follower 156 is oriented vertically. Again, the thrusters on the remotely operated vehicle correct the vertical orientation of the suction follower, if necessary. The results of the foregoing steps is illustrated in FIG. 12.

After the orientation of the plate anchor and the alignment of the suction follower have been assured utilizing the remotely operated vehicle, the remotely operated vehicle is employed to close the flow through ports of the suction follower. Thereupon the pumpskid 166 secured to the remotely operated vehicle 164 is clamped in engagement with the suction port of the suction follower 156, and is utilized to pump water out of the interior of the suction follower 156. This causes the suction follower to penetrate the sea floor 174 carrying the plate anchor with it. By means of the suction follower 156, the plate anchor 158 is located sufficiently deep in the sea floor 174 to assure that it will not pull out of the sea floor in response to anchoring forces.

Figure 13:
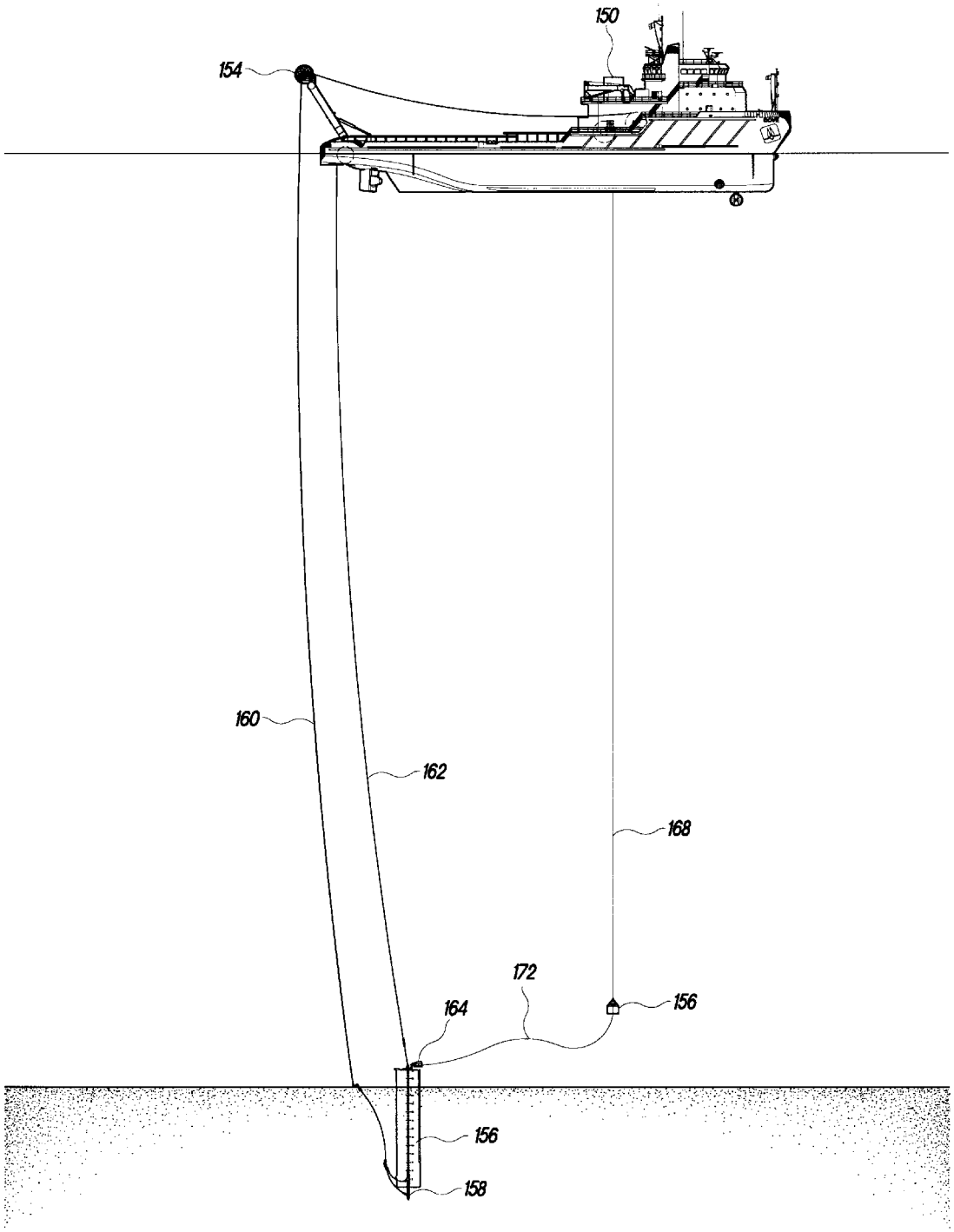
FIG. 13 is an illustration of a still later step in the practice of the method of the invention.
Figure 14:
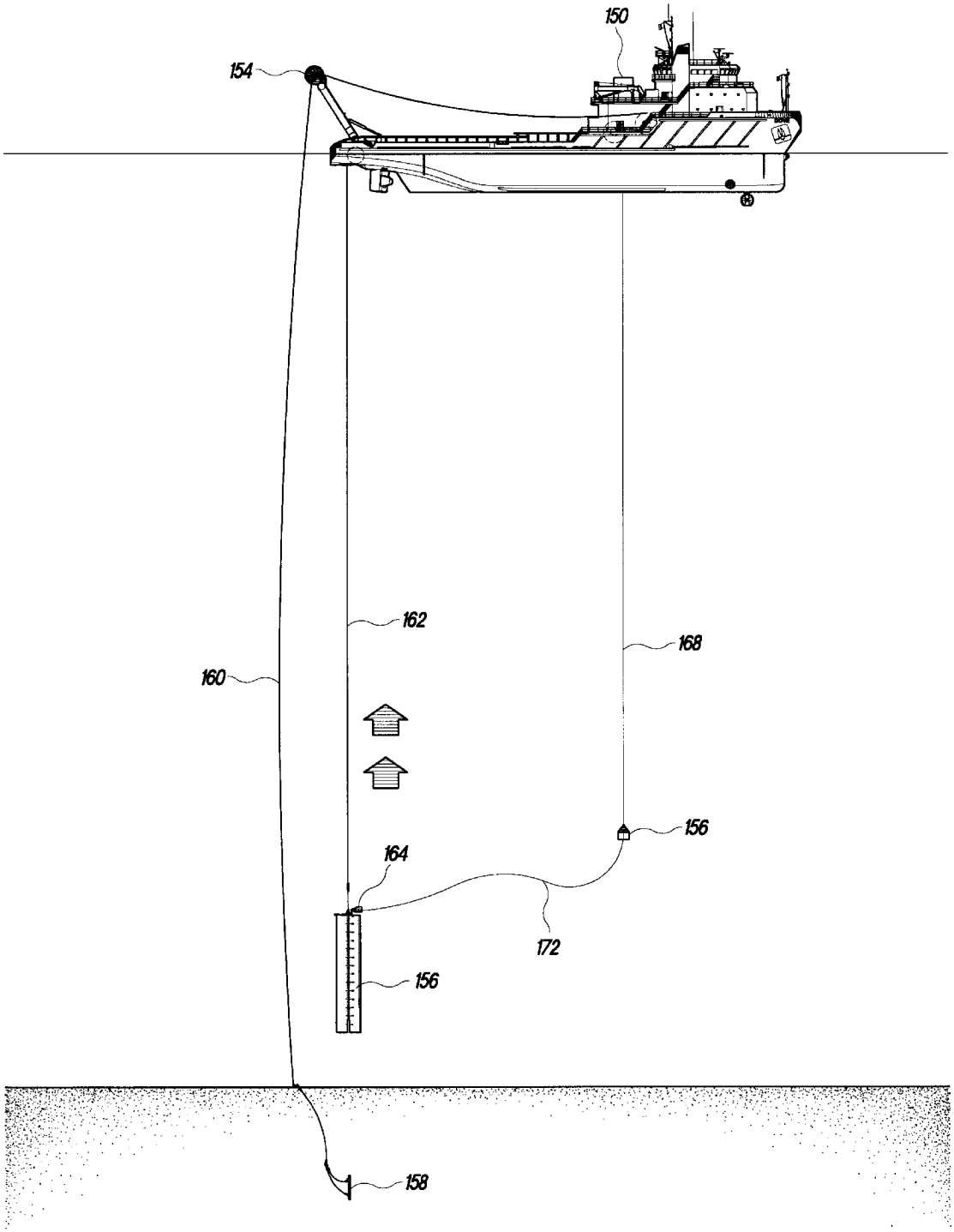
FIG. 14 is an illustration of a still later step in the practice of the method of the invention.

Referring to FIGS. 13 and 14, after the plate anchor 158 has been properly positioned by means of the suction follower 156, the remotely operated vehicle 164 is utilized to disengage the connections between the suction follower 156 and the plate anchor 158. Thereafter the pumpskid 166 is once again clamped in engagement with the suction port of the suction follower 156, it being understood that the connections between the suction follower and the plate anchor can be disengaged without disengaging the remotely operated vehicle from the suction port. Water is then pumped into the interior of the suction follower 156, causing the suction follower 156 to move upwardly and out of engagement with the sea floor 174. Disengagement of the suction follower 156 from the sea floor 174 is aided by the application of an upwardly directed force to the lowering/recovery line 162 by the vessel 150. The suction follower 156 and the remotely operated vehicle 164 having the pumpskid 166 mounted thereon are then recovered to the vessel 150 and the mooring line 160 is connected to the object to be moored. After the operations requiring mooring have been completed, the plate anchor 158 may be recovered, if desired.

Those skilled in the art will appreciate the fact that the pump used to pump water out of and into the suction follower of the present invention could be mounted thereon, with power being supplied along the lowering/recovery line. The use of a pumpskid on the remotely operated vehicle could then be dispensed with.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirt of the invention.

We claim:

1. An anchor installation apparatus comprising:

a suction follower comprising a hollow cylinder having a lower insertion end and an upper suspension end;

means for securing an anchor to the lower end of the suction follower for insertion thereby;

means connected to the upper suspension end of the suction follower for lowering the suction follower and the anchor secured thereto from the surface of a water body into engagement with the sea floor;

means for pumping water out of the interior of the suction follower thereby causing the suction follower and the anchor secured thereto to penetrate the sea floor;

means for disengaging the anchor from the suction follower after a pre-determined penetration has been achieved;

means for thereafter pumping water into the suction follower thereby disengaging the suction follower from the sea floor while leaving the anchor embedded therein.

2. The apparatus for anchor installation according to claim 1 further including:

a mooring line;

means connecting the mooring line to the anchor; and means for temporarily connecting the mooring line to the suction follower during installation of the anchor by the suction follower.

3. The apparatus for anchor installation according to claim 2 further including:

a remotely operated vehicle; and means on the remotely operated vehicle for disengaging the mooring line from the suction follower after installation of the anchor has been completed.

4. The apparatus for anchor installation according to claim 1 further including:

a remotely operated vehicle; and means mounted on the remotely operated vehicle for disengaging the anchor from the suction follower after installation of the anchor has been completed.

5. The apparatus for anchor installation according to claim 1 further including:

a remotely operated vehicle having a pump mounted thereon;

a suction port mounted on the suction follower; and means for engaging the remotely operated vehicle with the suction port on the suction follower thereby facilitating the pumping of water into and out of the suction follower under the action of the pump mounted on the remotely operated vehicle.

6. The apparatus for anchor installation according to claim 5 further including:

a mooring line connected to the anchor;

means for securing the mooring line to the suction follower during installation of the anchor thereby; and means operable by the remotely operated vehicle for disengaging the mooring line from the suction follower after installation of the anchor.

7. The apparatus for anchor installation according to claim 6 further including:

means mounted on the remotely operated vehicle for disengaging the anchor from the suction follower after installation of the anchor by the suction follower has been completed.

8. Apparatus for installation of a plate anchor in the sea floor comprising:

a suction follower comprising a hollow cylinder having an open lower insertion end and an upper suspension end which is substantially closed by a top plate;

closable flow through ports mounted in the top plate of the suction follower;

means for securing the plate anchor at the lower insertion end of the suction follower with the plate anchor oriented vertically;

means for securing the plate anchor to the suction follower during installation of the plate anchor in the sea floor by the suction follower;

means for lowering the suction follower with the plate anchor secure thereto from the surface of a water body into engagement with the sea floor;

means for opening the flow through ports of the suction follower during the lowering thereof from the surface to the sea floor;

means for thereafter closing the flow through ports of the suction follower;

a suction port mounted on the suction follower;

means for pumping water out of the suction follower through the suction port thereof after the suction follower has been engaged with the sea floor thereby causing the suction follower and the plate anchor mounted thereon to penetrate into the sea floor;

means for disengaging the plate anchor from the suction follower after the plate anchor has been installed in the sea floor by the suction follower;

means for thereafter pumping water into the suction follower through the suction port thereof thereby disengaging the suction follower from the sea floor for recovery to the surface while leaving the plate anchor embedded in the sea floor.

9. The apparatus for anchor installation according to claim 8 further including:

a mooring line;

means for securing the mooring line to the plate anchor;

means for temporarily securing the mooring line to the suction follower during installation of the plate anchor by the suction follower; and means for disengaging the mooring line from the suction follower after installation of the plate anchor in the sea floor.

10. The apparatus for anchor installation according to claim 9 further including:

a remotely operated vehicle;

a pump mounted on a remotely operated vehicle;

means for clamping the remotely operated vehicle to the suction follower with the pump operably connected to the suction port of the suction follower; and means for operating the pump on the remotely operated vehicle to first pump water out of the suction follower thereby causing penetration of the suction follower and the plate anchor carried thereby into the sea floor, and for thereafter causing the pump to pump water into the suction follower following disengagement of the plate anchor from the suction follower thereby causing disengagement of the suction follower from the sea floor.

11. The apparatus for anchor installation according to claim 10 further including means mounted on the remotely operated vehicle for disengaging the mooring line from the suction follower following installation of the plate anchor in the sea floor by the suction follower.

12. The apparatus for anchor installation according to claim 10 further including means mounted on the remotely operated vehicle for disengaging the plate anchor from the suction follower following installation of the plate anchor in the sea floor by the suction follower.

13. A method of anchor installation including the steps of:

providing a suction follower comprising a hollow cylinder having an open lower insertion end and a closable upper suspension end;

attaching an anchor to the lower insertion end of the suction follower;

lowering the suction follower and the anchor secured thereto into engagement with the sea floor;

closing the upper suspension end of the suction follower;

thereafter pumping water out of the suction follower thereby causing penetration of the suction follower and the anchor secured thereto into the sea floor;

thereafter disengaging the anchor from the suction follower;

thereafter pumping water into the interior of the suction follower thereby disengaging the suction follower from the sea floor while leaving the anchor embedded therein.

14. The method of anchor installation according to claim 13 further including the steps of:

providing a mooring line;

securing the mooring line to the anchor;

temporarily securing the mooring line to the suction follower during installation of the anchor by the suction follower; and disengaging the mooring line from the suction follower following installation of the anchor by the suction follower and prior to removal of the suction follower from the sea floor.

15. The method of anchor installation according to claim 14 further including the steps of:

providing a remotely operated vehicle; and utilizing the remotely operated vehicle to disengage the anchor from the suction follower after installation of the anchor in the sea floor by the suction follower.

16. The method of anchor installation according to claim 14 further including the steps of:

providing a remotely operated vehicle; and utilizing the remotely operated vehicle to disengage the mooring line from the suction follower subsequent to installation of the anchor in the sea floor by the suction follower.

17. The method of anchor installation according to claim 13 further including the steps of:

providing a remotely operated vehicle having a pump mounted thereon; and utilizing the pump of the remotely operated vehicle to pump water out of the suction follower thereby causing the suction follower to penetrate the sea floor to effect installation of the anchor therein; and subsequently utilizing the pump on the remotely operated vehicle to pump water into the suction follower thereby disengaging the suction follower from the sea floor after installation of the anchor in the sea floor.

18. A method of anchor installation according to claim 17 further including the steps of:

providing the suction follower with closable flow through ports mounted in the top plate thereof;

opening the flow through ports during lowering of the suction follower and the anchor attached thereto through the sea toward the sea floor;

utilizing the remotely operated vehicle to close the flow through ports of the suction follower prior to the pumping of water out of the interior of the suction follower.

19. The method of anchor installation according to claim 17 further including the step of:

utilizing the remotely operated vehicle to disengage the anchor from the suction follower subsequent installation of the anchor in the sea floor by the suction follower.

20. The method of anchor installation according to claim 19 further including the steps of:

providing a mooring line;

securing the mooring line to the anchor;

temporarily securing the mooring line to the suction follower during installation of the anchor in the sea floor by the suction follower; and utilizing the remotely operated vehicle to disengage the mooring line from the suction follower prior to removal of the suction follower from the sea floor.

21. An anchor installation system comprising:

a suction follower having a lower insertion end; and an anchor releasably secured to the suction follower at the lower insertion end thereof such that the anchor remains secured to the suction follower as the anchor and suction follower are lowered to the sea floor and as water is pumped out of the suction follower causing the suction follower and the anchor to penetrate the sea floor to a predetermined depth and such that the anchor is thereafter released from the suction follower and water is pumped into to the suction follower reversing the penetration of the suction follower from the sea floor, thereby leaving the anchor embedded therein.

22. The anchor installation system as recited in claim 21 wherein the suction follower has a slot in the lower insertion end thereof and the anchor is releasably secured therein.

23. The anchor installation system as recited in claim 21 wherein the anchor is releasably secured to the lower insertion end of the suction follower by at least one retaining wire connected between the anchor and the suction follower.

24. The anchor installation system as recited in claim 21 further comprising a lowering and recovery wire secured to the suction follower for lowering the anchor and the suction follower to the sea floor and for recovering the suction follower from the sea floor once the anchor has been embedded at the predetermined depth.

25. The anchor installation system as recited in claim 21 further comprising a mooring line operably coupled to the anchor for applying a mooring force to the anchor once the suction follower has released the anchor at the predetermined depth.

26. The anchor installation system as recited in claim 25 further comprising a bridle assembly operably coupled between the mooring line and the anchor.

27. The anchor installation system as recited in claim 21 wherein the anchor further comprises a plate anchor.

28. The anchor installation system as recited in claim 21 wherein the suction follower further comprises a hollow cylinder.

* * * * *